US006178905B1

(12) United States Patent
Dynes et al.

(10) Patent No.: US 6,178,905 B1
(45) Date of Patent: Jan. 30, 2001

(54) PERSONAL HYDROFOIL WATER CRAFT

(75) Inventors: Richard Dynes, Fairfax; Robert Justin Higgins; Peter C. Freeland, both of Springfield, all of VA (US)

(73) Assignee: WaveBlade Corporation, Fairfax, VA (US)

( * ) Notice: Under 35 U.S.C. 154(b), the term of this patent shall be extended for 0 days.

(21) Appl. No.: 09/177,622

(22) Filed: Oct. 23, 1998

Related U.S. Application Data

(60) Provisional application No. 60/097,053, filed on Aug. 19, 1998.

(51) Int. Cl.[7] ..... B63B 1/24

(52) U.S. Cl. ..... 114/55.54; 114/55.55; 114/55.57

(58) Field of Search ..... 114/55.54, 55.55, 114/274, 276, 280, 281, 55.56, 55.57, 363; 441/72

(56) References Cited

U.S. PATENT DOCUMENTS

| | | | | |
|---|---|---|---|---|
| 2,387,907 | * | 10/1945 | Hook . | |
| 2,748,400 | * | 6/1956 | Kregall | 114/55.55 |
| 2,931,332 | | 4/1960 | Hebrank . | |
| 3,120,011 | * | 2/1964 | Gunderson | 441/72 |
| 3,158,129 | | 11/1964 | Mauer . | |
| 3,710,750 | * | 1/1973 | Welsh | 114/55.54 |
| 3,722,450 | * | 3/1973 | Arimura . | |
| 3,915,106 | * | 10/1975 | Witt . | |
| 3,964,417 | | 6/1976 | Williams et al. . | |
| 4,579,076 | * | 4/1986 | Chaumette | 114/275 |
| 4,625,669 | * | 12/1986 | Nishida | 114/55.57 |
| 4,711,195 | | 12/1987 | Shutt . | |
| 5,117,776 | | 6/1992 | Thorpe . | |
| 5,448,963 | | 9/1995 | Gallington . | |
| 5,520,133 | | 5/1996 | Wiegert . | |
| 5,547,406 | | 8/1996 | White . | |
| 5,653,189 | * | 8/1997 | Payne | 114/274 |

FOREIGN PATENT DOCUMENTS

| | | | |
|---|---|---|---|
| 2117 712 | | 10/1983 | (GB) . |
| 97/29010 | * | 8/1997 | (WO) . |

OTHER PUBLICATIONS

Axtell, A.T., "Introducing the Hydrocycle", *The Rudder,* Jul., 1956.

Printout from World Widw Web site for "Trampofoil", 11 pages total website URL: www.trampofoil.se, date unknown.

Printout from Internet site for "Decavitator Human Powered Hydrofoil", 4 pages total, URL: lancet.mit.edu/decavitator; date unknown.

* cited by examiner

*Primary Examiner*—Sherman Basinger
(74) *Attorney, Agent, or Firm*—Miles & Stockbridge P.C.; John C. Kerins

(57) ABSTRACT

A hull-less personal water craft is provided which reduces air, water, noise, and wake pollution over personal water craft presently on the market. The craft includes a strut assembly having forward and rearward ends, with an operator platform attached at the rearward end, and having at least one hydrofoil positioned substantially underneath the operator platform at a predetermined distance. A propulsion system is provided at the forward end of the strut, and is operatively coupled to a control column which provides the operator interface when the craft operator is kneeling or standing on the operator platform. The hydrofoil provides substantially all of the lift for the craft when in operation, and the elimination of a hull greatly reduces the power requirements and wake generated by the craft in operation.

21 Claims, 14 Drawing Sheets

PERSONAL HYDROFOIL WATER CRAFT

The subject application is based on subject matter disclosed in provisional application Ser. No. 60/097,053 filed Aug. 19, 1998, in the name of Richard Dynes and Robert Higgins and claims priority of said application under the provisions of 35 USC §119(e).

BACKGROUND OF THE INVENTION

1. Field of the Invention

The present invention is directed to a water craft for personal recreational use, in which the water craft employs a hydrofoil lift system.

2. Description of Related Art

Personal water craft (PWC) vehicles have enjoyed immense popularity in recent years. PWCs generally allow one, two or more riders to sit, kneel or stand on the craft and to ride across the surface of a body of water. The popularity of PWCs is also attributable to the considerations that they are less expensive than traditional power boats, are more easily transported over land by smaller trailers, and storage and maintenance of the PWCs is generally simpler than with full size power boats.

The popularity of such craft, and their operational characteristics, have led to several significant problems. The sheer number of such craft on some popular bodies of water has led to congestion, which adversely impacts safety. More significantly, existing PWC designs generate substantial noise, water, wake and air pollution. These PWCs have disproportionately large engines, with current models having 110+ horsepower engines, and, in the quest for increased speed, the power plants are only likely to become more powerful, in the absence of regulation. The hull form of current PWCs generates substantial wakes, which are a disturbance and a nuisance to other users of the waterways, and can adversely affect the safety of operating craft, both PWCs and boats.

Planing hulls are used in most recreational water craft, including PWCs. The planing hull design has been popularized due to its ability to permit craft operation at speeds in excess of the craft's natural hull speed. These hulls produce a downward reaction in the water by impacting the surface of the water with a low aspect ratio wedge, which produces large wakes.

The problems and costs associated with wake generation cannot be underestimated. The U.S. Coast Guard regulates speed, and holds operators of water craft responsible for damage due to wakes. Enforcement of the regulations is problematic, as wakes from motor boats can travel large distances before being encountered and causing damage, and identification of the offending vessel is often difficult. Wakes can also impair the operation and control of other water craft, with resulting detrimental impacts on safety. Wakes further can cause damage to docks and docked water craft.

The prevalent PWCs employ a water jet as the propulsion means. Water jets are prone to generating large amounts of noise pollution, in that, due to wave action and the presence of wakes, the PWC frequently lifts from the water sufficiently to break the intake suction of the jet. Noise volume and pitch increase as a result, due to the jet ingesting and expelling air.

Various other water recreation devices have been employed over the years, most notably water skis. Many other towed devices, ranging from inflated tubes to bicycle style devices employing hydrofoil lift have been used or proposed for use. U.S. Pat. No. 3,105,249, discloses a device meeting the latter description. All such devices suffer from the drawback that a motor boat must be used to propel (pull) the device. The motor boat, like the PWCs discussed above, is noisy, uses a planing hull which creates substantial wakes, and pollutes the water.

Other watergoing vehicles have been proposed which employ hydrofoils as part of the lift or control system of the craft. Hydrofoils are usually utilized to permit operation of a water craft in excess of speeds efficiently attainable with conventional hull forms. Often, hydrofoils have been proposed for use with hulled craft, whereby the craft will travel at low speeds using the displacement of the hull, and, at higher speeds, lifted partially or completely out of the water on a hydrofoil.

The high speeds attainable with hydrofoils are accomplished in that a hydrofoil provides a more efficient means of providing the lift necessary to float or ride on the water. Conventional displacement hulls simply displace a volume of water equal to the weight of the vehicle. Planing hulls displace water at lower speeds, and, at higher speeds, provide a crude form of lift by impacting the water downwardly, elevating the craft from the water and permitting higher speeds.

There continues to exist a need for an efficiently operating personal water craft (PWC) vehicle that avoids or minimizes the environmental impacts resulting from the widespread use of planing hulled craft. Further, efforts are ongoing to improve the recreational experience of such craft, which, in the conventional, planing hull PWC design, can largely be achieved only through increasingly powerful engines to provide increased speed.

A principal object of the present invention is thus to provide a PWC design which provides many, if not all, of the benefits of existing PWC designs, but which eliminates or significantly reduces the noise, water, air and wake pollution associated with the operation of conventional PWCs, principally through the elimination of the hull structure and the reliance on the use of hydrofoil lift for the craft.

It is a further principal object of the present invention to provide a PWC design that is more efficient in operation and has much lower power requirements, for equivalent on-water performance, as compared with conventional PWC designs.

It is an additional important object of the present invention to provide a fast and dynamic vehicle that may operate legally in waterways in which other, larger powered water craft have been or may be restricted by laws or regulations limiting the available motor power.

It is a further object of the present invention to provide a PWC design which is convenient and enjoyable to use, and is easy to maintain and transport.

SUMMARY OF THE INVENTION

The above and other objects of the present invention are achieved by providing a water craft which uses a hydrofoil or a plurality of hydrofoils as the sole means of suspending the craft operator above the surface of the water, such that the craft or vehicle can operate with dramatically less power than comparable water craft, such as conventional PWCs. The hydrofoil-based personal water craft of the present invention will thus operate with considerably less air, water, and noise pollution, and will generate far less wake than do hulled craft. The water craft further employs an operator platform designed with a suitable aspect ratio to provide hydrodynamic lift at startup, to aid in transitioning the craft from its startup position to its running position.

The hydrofoil craft of the present invention includes a main hydrofoil subassembly including an operator platform on which the operator will stand, sit, or kneel, and a hydrofoil extending from below the platform. This subassembly is coupled to a propulsion system which is disposed forwardly of the hydrofoil subassembly. The hydrofoil craft is steered and/or controlled by a handlebar-type assembly that extends rearwardly from a position adjacent to the propulsion system, placing the handlebars in position to be held by the operator when the operator is kneeling or standing. The propulsion system itself may be either an axial flow impeller type, or a ducted propeller type system, and the handlebar controls for power and steering will be tailored to the specific type of propulsion unit provided.

A strut assembly is used to couple the main foil assembly to the propulsion and steering systems, and the craft thus has no hull. Floatation devices may optionally be secured to the strut assembly, and/or to the operator platform, to give the craft sufficient buoyancy to prevent full submersion of the craft when the craft is idle or stationary.

The operator platform is designed with a suitable aspect ratio such that, at low speeds, it can function as a larger foil to aid in lifting the platform out of the water to achieve running configuration. After providing hydrodynamic lift, as the platform emerges from the water with an increase in vehicle speed, the platform will temporarily function as a planing surface, until it clears the surface of the water and becomes completely foil-borne.

The upper surface of the platform preferably includes a non-slip surface, in order to provide increased traction for the operator's feet, and also includes small toe and heel (front and rear) cups or chocks to allow the operator to brace his or her feet against the flow of water crossing the platform.

The forward-mounted propulsion system may incorporate one or more hydrofoils, in order to provide lift to the propulsion system when in operation. The forward portion of the craft, namely where the forward end of the handlebar column is coupled to the propulsion system, also includes hydrofoils to control the depth of, or the elevation of, the front end and propulsion system while operating at low speeds and at full speed.

BRIEF DESCRIPTION OF THE DRAWINGS

These and other features, aspects and advantages of the present invention will become better understood when the following detailed description is read with reference to the accompany drawings, wherein.

DETAILED DESCRIPTION OF THE PREFERRED EMBODIMENTS

Figure 1:
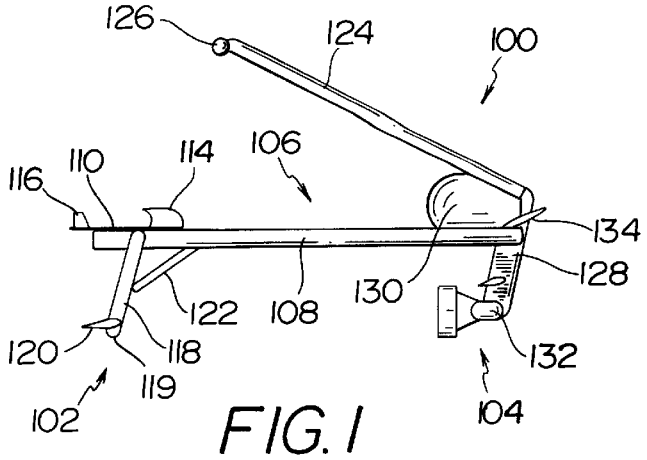
FIG. 1 is a substantially schematic side elevation view of the hydrofoil water craft in accordance with a preferred embodiment of the present invention.
Figure 3:
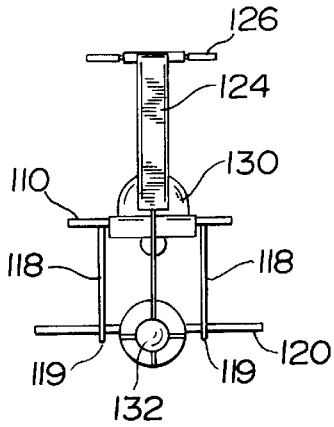
FIG. 3 is a substantially schematic front elevation view of the hydrofoil water craft in accordance with a preferred embodiment of the present invention.
Figure 2:
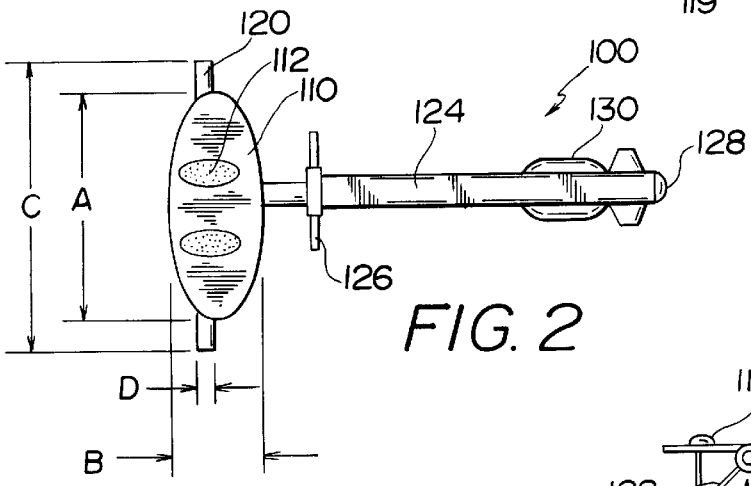
FIG. 2 is a substantially schematic top plan view of the hydrofoil water craft in accordance with a preferred embodiment of the present invention.

Referring initially to FIGS. 1–3, a water craft 100 employing hydrofoil lift in accordance with a preferred embodiment of the present invention is illustrated. Craft 100 includes a main or rear hydrofoil subassembly 102, and a forward steering and propulsion subassembly 104, and a strut assembly 106 connected to and extending between the forward and rear subassemblies.

In accordance with the present invention, the water craft is defined as being hull-less. The term hull-less water craft, as used herein, means a craft having at least one normal operating position for the rider in which an adult person, when in such operating position, and while the craft is at rest in calm water, will necessarily be in contact with the water.

The strut assembly illustrated in FIGS. 1–3 is a single strut 108, preferably a hollow tube having a circular cross-sectional shape. The strut may preferably be on the order of four inches (4") in diameter, and made of aluminum or other high-strength, lightweight material which is resistant to corrosion in fresh water and in sea water. Plain carbon steel tubing with a corrosion-resistant paint or coating could alternatively be employed, as could a fiber-reinforced plastic or other engineering thermoplastic.

The rear or main hydrofoil subassembly 102 includes an operator platform 110 which is sized to accommodate the feet of the operator (10, FIGS. 14B–D), and to permit the operator to kneel comfortably thereon. The platform 110 preferably has a high traction, non-slip surface 112, at least at the central portions where the operator's feet will normally be placed, although the entire upper surface could be made of a non-slip material, if desired. Platform 110 preferably has front and back footing cleats 114, 116, respectively, secured thereto, with the front cleats 114 provided to break the flow of water to minimize the force of any water flowing across the upper surface of the platform on the operator's feet. The back cleats 116 are provided to aid in preventing the operator's feet from slipping off the platform. The cleats are illustrated in FIG. 1, but are omitted from FIG. 2, in order to show, in FIG. 2, the non-slip surface 112.

The platform 110 provides several important functions in addition to providing a footing surface. The platform will have on the order of thirty pounds (30 lbs.) of buoyancy, by virtue of its displacement in the water, which serves to maintain the rear hydrofoil assembly in a position close to the surface of the water when the craft 100 is not being propelled through the water. Also, due to the length A and width B of the platform, preferably on the order of about 40 inches or less, and 18 inches or less, respectively, and the thin cross-section thereof, the platform 110 will act as a hydrofoil, providing lift during the initial take-off of the craft, as will be discussed in greater detail later.

The aspect ratio of the operator platform is desirably about 1 to 2 (½) or greater, in order that sufficient lift is generated during take-off. Even more preferably, an aspect ratio of 1 (1 to 1) or greater is desired in order to aid in readily and quickly lifting the operator platform to the surface of the water.

The hydrofoil subassembly further has a pair of foil struts 118 secured to the underside of the platform 110, and depending downwardly therefrom. A main foil 120 is secured at the lower ends of the foil struts. Rounded ends 119 of the foil struts extend a short distance below the main foil 120, in order to reduce vehicle drag when transporting the vehicle across land, and in order to minimize the possibility that the foil will ground itself against the bottom of the body of water.

The main foil 120 is preferably somewhat greater in length C (on the order of 48 inches or less) and smaller in width D (on the order of 4 inches or less) than platform 110, and the cross-sectional shape thereof is designed to provide lift. The length of the foil struts may preferably be on the order of thirty inches (30"), thus spacing the main foil 120 from the operator platform at that distance.

The operator platform 110, foil struts 118 and main foil making up the rear foil subassembly may be made from aluminum, and, in this instance the struts may be joined to the platform and to the main foil by welding. Other materials can optionally be employed, including composite materials, injection molded plastics, rotomolded plastics, and even different materials may be employed for the platform, foil struts, and main foil, i.e., materials selection for the components is not seen as being critical to the construction of a craft 100 in accordance with the invention. Where other or dissimilar materials are used, other conventional joining or fastening means, including, for example, riveting, threaded connections, or adhesives, will be readily recognized as being possible candidates for use.

The main or rear foil subassembly 102 is secured to strut 108, as by welding, if all aluminum components are employed, or by other suitable connectors or fastening means. Strut 108 defines a centerline of the craft 100, as it is connected to the platform 110 at a center line of the platform. Foil struts 118 are laterally spaced equidistantly from strut 108, and the main foil 120 is centered on the craft as well. The connection of the main foil subassembly 102 to strut assembly 106 is reinforced by the provision of a pair of angled support bars 122 rigidly fastened between strut 108 and the foil struts 118.

Figure 4:
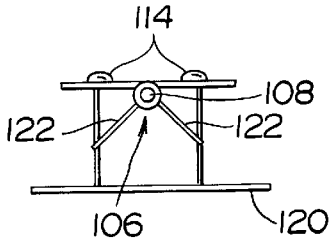
FIG. 4 is a substantially schematic front elevation view of a main hydrofoil subassembly in accordance with a preferred embodiment of the present invention.
Figure 5:
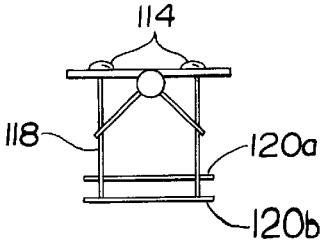
FIG. 5 is a substantially schematic front elevation view of a main hydrofoil subassembly in accordance with an alternative preferred embodiment of the present invention.
Figure 6:
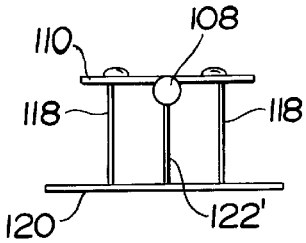
FIG. 6 is a substantially schematic front elevation view of a main hydrofoil subassembly in accordance with a further alternative preferred embodiment of the present invention.

FIGS. 4, 5 and 6 illustrate, in substantially schematic form, alternative preferred configurations for the rear or main hydrofoil subassembly 102. FIG. 4 shows the subassembly 102 in the configuration shown in FIG. 1, with the operator platform 110, front foot cleats 114, foil struts 118, main foil 120, and also showing the rearward portion of strut assembly 106, strut 108 and angled support bars 122.

FIG. 5 illustrates an alternative configuration in which the only difference is that the main foil actually comprises a pair of spaced apart foils 120*a* and 120*b* attached to foil struts 118. FIG. 6 illustrates a single foil construction, but with a centrally disposed support bar 122' connected between strut 108 and the main foil 120. As can readily be envisioned from viewing FIG. 6, the centrally disposed support bar 122' may be used as a single foil strut, which construction would eliminate the need for side foil struts 118. These various embodiments are shown to illustrate that the connections and supports between the main body strut 108 and the main hydrofoil subassembly 102 are not seen as being critical to proper operation of the craft 100, nor is the specific foil configuration.

Returning to FIGS. 1–3, the strut assembly 106 has a steering or control subassembly and a propulsion subassembly 104 disposed at the forward end of strut 108. While the illustrated embodiments all depict the propulsion subassembly 104 being located at or near the front end of the craft, it is to be recognized that the propulsion may be provided at essentially any position along the length of the craft. Thus, while it is presently believed that providing both the propulsion subassembly and the steering or control subassembly at the forward end of the craft should provide the best overall performance, it is not seen as being critical that the propulsion subassembly be so located. Certain advantages in stability and maneuverability are obtained, however, by having the steering or control subassembly at or near the forward end of the craft.

Shown schematically in FIGS. 1–3 are a control column 124, having a handlebar 126 at a distal end thereof, and being operatively coupled to a control housing 128 at a proximal end thereof. A motor housing 130 is disposed rearwardly of control housing 128, and underneath control column 124, and is secured to strut 108 by suitable mounting hardware or welding. A propulsor housing 132 is disposed at a lower end of control housing 128. Details of the construction and operation of, and the components contained within, these housings will be discussed in greater detail in the discussion of other drawing figures presented. An anti-dive plate 134 is preferably provided on control housing 128, which has a flat surface area oriented such that, when the forward end of the craft begins to dive, the plate will impact the surface of the water with a positive angle of attack, which will prevent or greatly dampen any further diving motion.

It can further be seen in FIG. 1 that the control housing 128 is angled toward the rear of the craft, and that the control housing 128 and the propulsor housing present a swept-back, rounded nose at the lower extent of the forward end of the craft. This design aids in preventing the craft from becoming grounded in shallow water and aids in transporting the craft over land.

The invention described thus far is a hull-less water craft which is capable of floating in a partially submerged condition when not in motion, and which, in operation, is lifted in the water by a hydrofoil assembly disposed underneath an operator platform, wherein the hydrofoil assembly bears the weight of the operator and the rear portion of the craft. The propulsion subassembly propels the hydrofoil, platform and operator through the water, and the craft is controlled by the operator by a handlebar control extending rearwardly toward the operator platform from the forward control subassembly. Overall, the craft operates as a self propelled sled.

Figure 7:
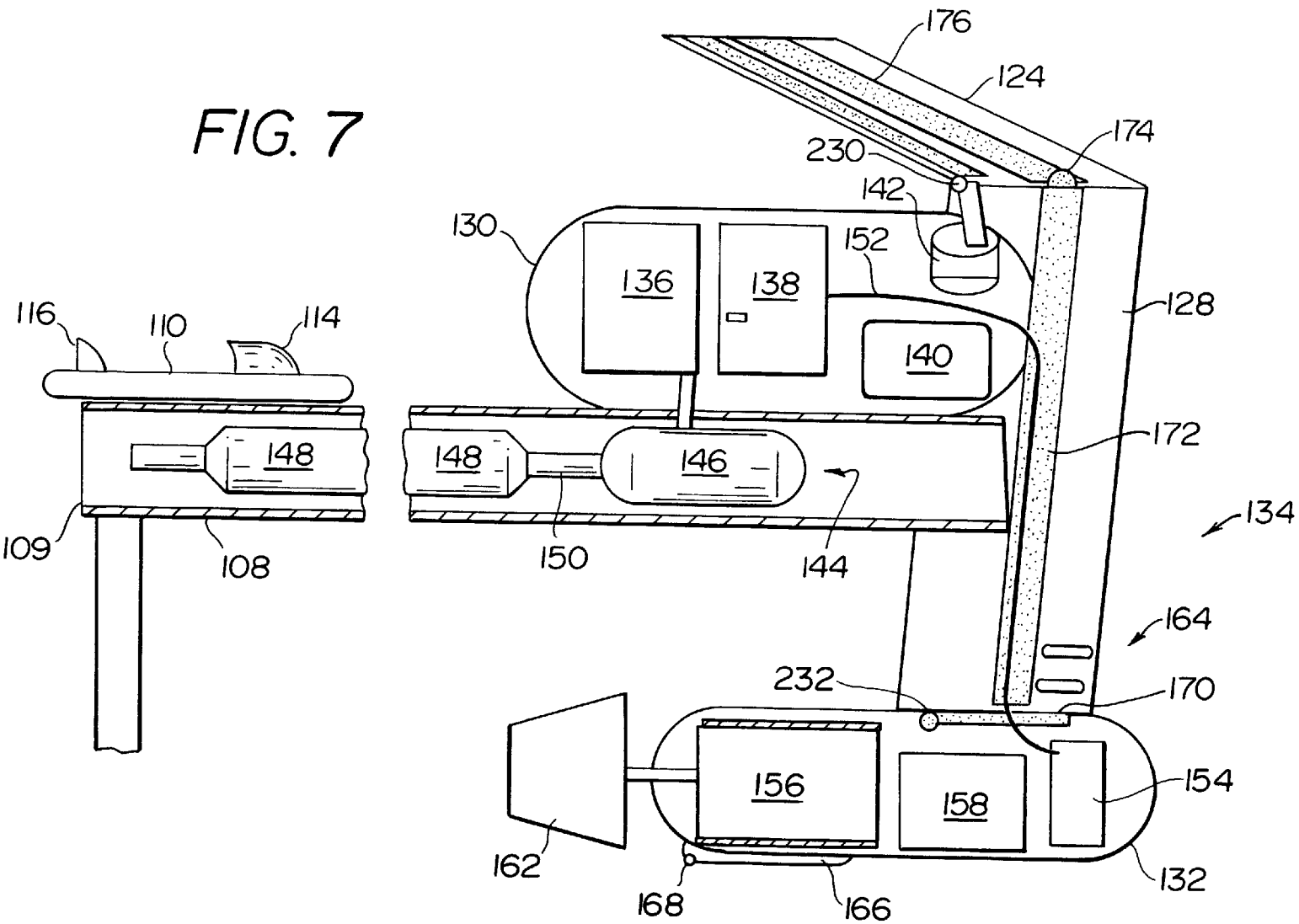
FIG. 7 is a substantially schematic view of a propulsion system and the arrangement of the components thereof in accordance with a preferred embodiment of the present invention.

FIG. 7 illustrates, in substantially schematic form, a preferred arrangement or embodiment of a propulsion subassembly 134 and other associated components. The illustrated subassembly is referred to as a split propulsion system, in that certain components are housed in motor housing 130, and other components are housed in propulsor housing 132. A split system has the advantage of reducing the size of the housing (propulsor housing 132) that will remain submersed at full operating speed. This yields a lower cross-section presented to the water, thus lowering the form and wetted area drag of the propulsion system.

The selection of which components are positioned in the motor housing 130 and in the propulsor housing 132 generally follows a logical division of the components required to be submersed in operation, and those that are not. In FIG. 7, the motor housing 130, which will travel above the water surface at operating speeds, has a reciprocating motor 136, a generator 138 driven by the reciprocating motor, and a fuel tank 140 supplying to the reciprocating motor, disposed therein.

The motor housing optionally has an induction fan 142 in fluid communication with the outside environment, which is used to maintain a positive pressure in the motor housing 130. It may also be desirable to fluidly couple the propulsor housing 132 to the motor housing 130, in order to maintain a positive pressure throughout both housings. Maintaining this positive pressure will provide a moderate boost in engine performance and will make the propulsion system less susceptible to small leaks, and provides a means of continuously draining sump 166 through valve 168.

Mounting the reciprocating motor 136 in an upper motor housing 130 positioned above (as illustrated) or alongside (not shown) the strut assembly 106 desirably allows the interior of strut 108 to house an exhaust system 144, which can include an exhaust resonator 146, a muffler 148, and tubing runs 150 connecting the motor exhaust chamber or manifold to the exhaust resonator and connecting the resonator to the muffler. In this preferred embodiment, the strut 108 is left open at the rear end 109 thereof, as well as at its front end, such that the strut 108 is free flooding, and so that the exhaust gases will advantageously exit the vehicle at the rear thereof. It is estimated that, due to the ability to provide a long, linear muffler 148 in the strut 108, the above-water exhaust system would achieve approximately the same level of noise reduction as would a submerged exhaust port. When the strut 108 is used to house the exhaust system, the motor housing 130 and the strut 108 will be joined such that a passage or opening is provided between the two components to allow the connection of the tubing run 150 between the motor 136 and exhaust resonator 146.

Generator 138 is electrically connected by cable or wiring 152 to a controller 154, which controls operation of electric drive motor 156, and the distribution of power to the motor 156 and battery 158. In this way, the generator supplies power to the motor 156 through controller 154, and also supplies power to battery 158. Battery 158 provides the charge for ignition, and may also be employed to intermittently provide power in initial takeoff and acceleration modes. The controller 154, battery 158 and drive motor 156 are housed within propulsor housing 132 in the FIG. 7 embodiment.

Drive motor 156 has an output shaft 160 which extends through the rear of the propulsor housing, and the shaft 160 is operatively coupled to a propulsor means 162, shown schematically in FIG. 7. The propulsor means 162 is preferably a ducted propeller or an axial flow impeller, both of which are available in the market, and both of which are relatively safe and efficient for use in this particular service.

Drive motor 156 may be jacketed so as to be conduction cooled. Small openings 164 are provided in a lower portion of control housing 128 to function as a water inlet, which water is to be collected and directed to the reciprocating motor 136 and to exhaust system 144 (through the open front end of strut 108), for cooling those components while the craft is foil-borne.

Propulsor housing 132 may preferably be provided with a sump 166 at the lower extent of the housing, with a popette valve or another selectively openable means. The sump will collect water that enters the housing, and the water may be drained or forced out through valve 168.

As shown in this FIG. 7 embodiment, the propulsor housing is coupled to the craft by a plate 170 that is secured to a lower end of a control rod 172. Control rod 172 is mounted inside control housing 128 and is rotatable about its longitudinal axis. Control rod 172 is itself coupled by a universal joint (shown schematically at reference numeral 174), to a steering bar 176 extending within control column 124. Steering bar 176 is coupled to handlebar 126 in a manner such that, when the handle bar is pivoted, the steering bar will rotate about its longitudinal axis, and, through universal joint 174, will cause control rod 172 and plate 170 to rotate. Steering is thus effected in this embodiment by rotating the handlebar 126, which, through the described linkage, rotates propulsor housing 132 to a desired angle relative to the longitudinal axis of the craft.

Figure 8:
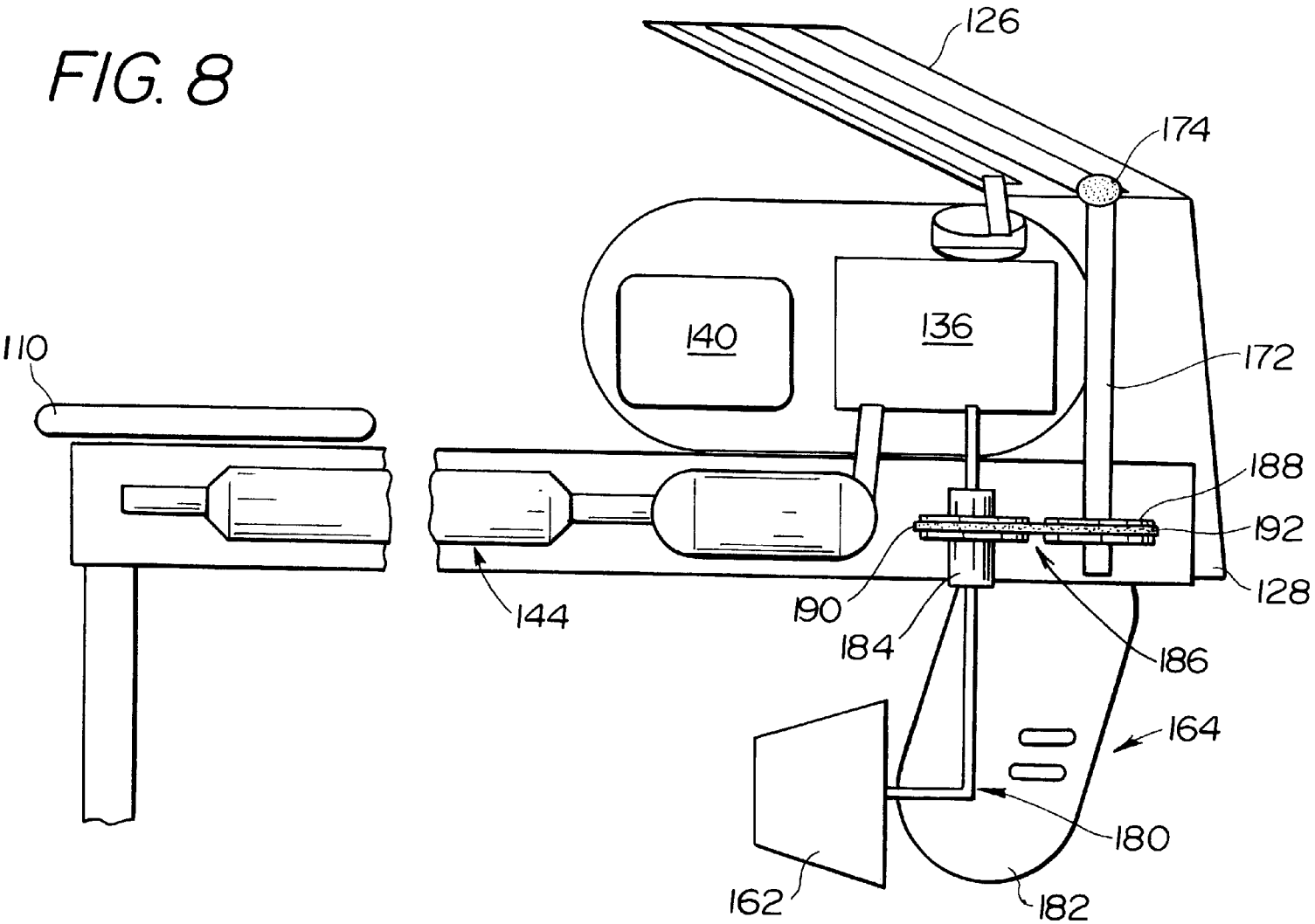
FIG. 8 is a substantially schematic view of a propulsion system and the arrangement of the components thereof in accordance with another preferred embodiment of the present invention.

FIG. 8 depicts another preferred arrangement for the propulsion subassembly. This arrangement resembles, to some extent, the configuration of an outboard motor. This embodiment may preferably employ the same exhaust system 144 as in the FIG. 7 embodiment.

In this embodiment, the pressurized motor housing 130 encloses a fuel tank 140 and a motor 136. The output of the motor 136 powers a drive shaft assembly 180, which drives the propeller 162 or other propulsor means. A swept-back, rounded, drive shaft housing 182 encloses a majority of the submersed portion of the drive shaft assembly, and the housing 182 is pivotably or rotatably coupled at the underside of the control housing 128.

Control rod 172 in this embodiment is coupled to a rotatable motor mount 184, by a steering coupling 186, illustrated as a pair of pulleys 188, 190 and a belt 192 extending between the pulleys. Steering is effected by rotating the handlebar 126, as in the FIG. 7 embodiment, which causes control rod 172, and pulley 188 connected thereto, to rotate. Through belt 192, the second pulley 190 is rotated, which rotates the drive shaft housing 182, drive shaft assembly 180 and propeller 162.

Figure 9:
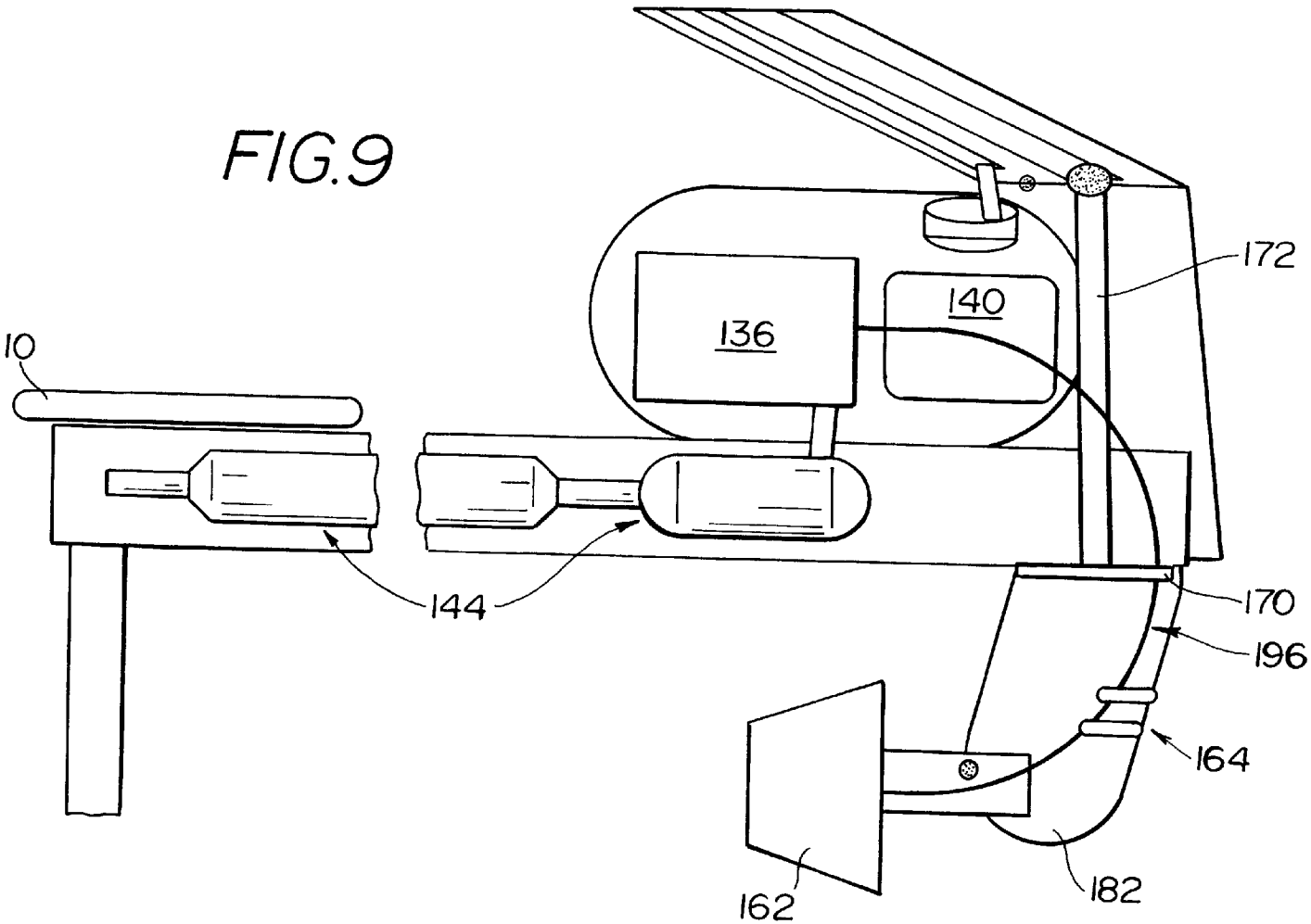
FIG. 9 is a substantially schematic view of a propulsion system and the arrangement of the components thereof in accordance with a further preferred embodiment of the present invention.

A further preferred propulsion subassembly configuration is illustrated in FIG. 9. This configuration replaces the rigid, geared drive shaft assembly 180 shown in FIG. 8 with a flexible drive cable or shaft 196. The use of the flexible drive shaft 196 enables the use of the simpler steering system shown in FIG. 7. In this embodiment, drive shaft housing 182 is coupled to a control rod 172 at a lower plate 170 attached thereto. Rotation of the drive shaft housing 182 and propeller 162 to effect steering takes place in a manner similar to the manner in which propulsor housing 132 is rotated in the FIG. 7 embodiment.

Figure 10:
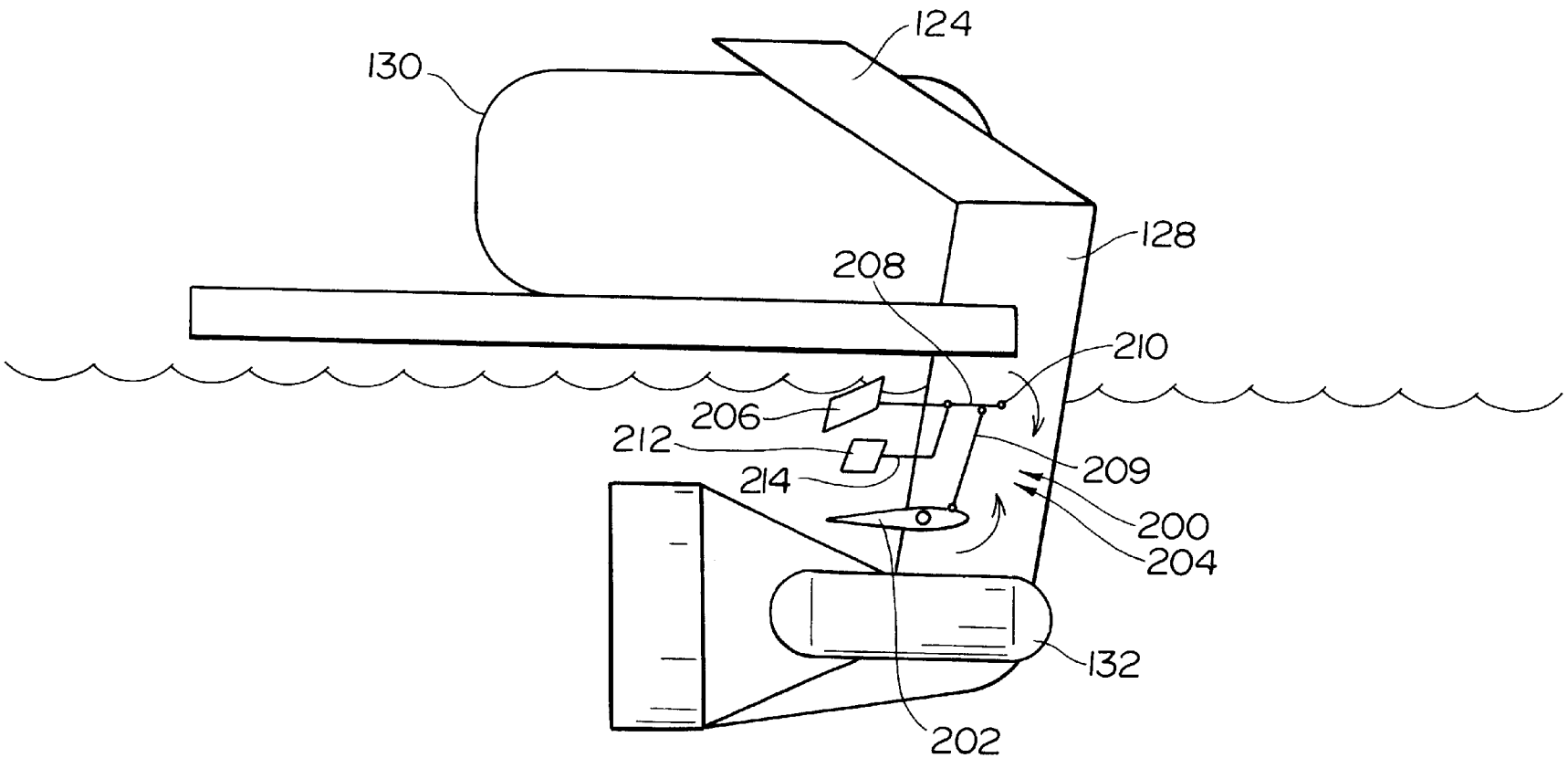
FIG. 10 is a substantially schematic side view of a forward end of the hydrofoil water craft of the present invention, showing details of a preferred forward depth control system for the propulsion system.

FIG. 10 illustrates a preferred embodiment of a forward end propulsion system depth control system 200. The depth control system 200 employs one or more pivotable foils 202 (one shown) extending laterally from opposite sides of control housing 128. The foil or foils 202 are preferably pivoted at their center of lift, and the pivot means can be a pin or pins extending from the foils 202 through the walls of control housing 128. The angle of attack of the foils 202 is controlled by sensor 204, which includes a large, inclined sensor plate 206 attached to an arm 208 pivotably secured to control housing 128. Arm 208 is connected to one or both of the foils 202.

As shown, in a preferred embodiment, the plate 206 and arm 208, and the foils 202, are in a substantially neutral position, i.e., substantially parallel to the surface of the water, when the propulsor housing and the front of the craft are traveling stably at approximately the desired depth. Plate 206 is designed such that it will substantially skim the surface of the water. Thus, as the front end of the vehicle begins rising farther out of the water, plate 206 will descend, pushing downwardly on the front of the foils 202, by action of the pivoting arm 208, to position the foils to have a negative angle of attack. The foils thus impart a downward force on propulsor housing 132, substantially preventing it from rising any higher in the water. The ability to generate the negative angle of attack is an important and significant feature, in that the operator on platform 110 may have a tendency to lean back and/or pull back on handlebars 126, both of which will tend to cause the craft to attempt to raise the front end thereof. The depth control system will, in all conceivable instances, be capable of retaining the front end in the water.

When the front end of the vehicle begins to descend past the desired neutral position, plate 206 pivots upwardly, causing arm 208 to pull upwardly on the front of foils 202, thus providing a desired positive angle of attack to substantially prevent further descent of the front end, and to urge the front end back to the neutral position.

A damper foil 212 and arm 214 may preferably be secured to arm 208 at the side of pivot point 210 to which plate 206 is attached. The damper foil 210 will be positioned to remain submerged during normal operation, and will damp or stiffen the sensor 204, making it less sensitive to wave action or other water surface level transients.

Figure 11:
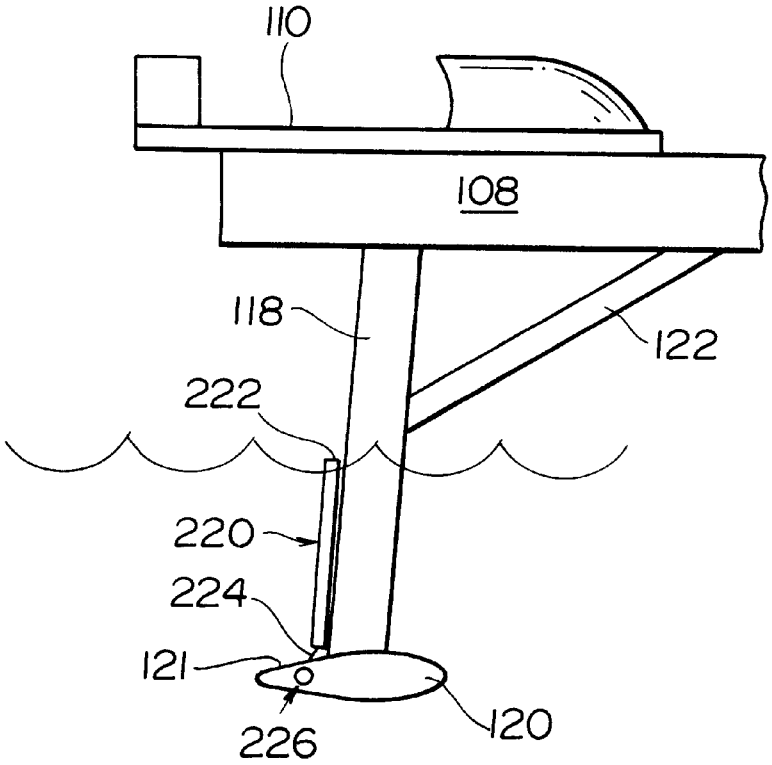
FIG. 11 is a substantially schematic side elevation view of the main hydrofoil subassembly illustrating details of a depth control system for the hydrofoil subassembly.
Figure 12:
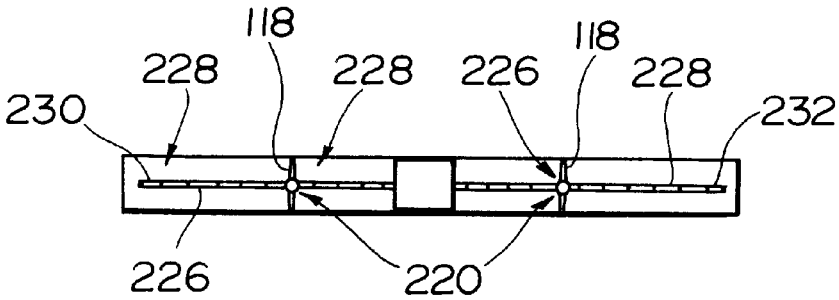
FIG. 12 is a top plan view of a foil to be employed in the main hydrofoil subassembly in accordance with a preferred embodiment of the present invention.

FIGS. 11 and 12 illustrate features that may advantageously be included on the rear foil subassembly 102, in order to provide depth control for the foil and rear portion of the craft. More specifically, these figures show the use of ventilation means provided to reduce the lift of the foil, and thus to regulate the minimum depth (maximum height) attained by the foil in operation.

In FIG. 11, a ventilation tube 220 is shown extending upwardly from the upper surface 121 of foil 120, alongside foil strut 118. An identical ventilation tube would be similarly positioned on the second foil strut (not shown). The low pressure region present on the top of the lifting foil 120 is used by tube 220 to induct air from above the surface of the water to the top of the foil. This air induction, also referred to as ventilation, has the effect of dramatically reducing the lift generated by the foil.

Thus, in the present invention, the ventilation tube 220, when fully submerged, has no substantial ventilating effect, and the lift provided by the foil will raise the foil 120 and the operator platform 110. The length of the ventilation tube 220 is selected such that an upper end 222 thereof breaks the surface of the water when the foil 120 reaches a predetermined level below the surface of the water corresponding to the desired closest distance of approach of the foil to the surface of the water, and the desired elevation of the platform 110 in operation.

When the upper end of the tube breaks the surface, ventilation commences, thereby dramatically reducing lift. As a result, the foil will remain substantially at that level in the water. At this position, the top of the tube will spend a portion of time exposed to the air and a portion of the time submerged, due to the natural action of crossing even small waves or wakes. This has the effect of providing a smooth transition from the normal to the ventilated condition. The ventilation system becomes more effective at higher craft speeds, due to the increased tendency of the vehicle to climb, with even the minimal lift provided by the ventilated foil.

The opening at the lower end 224 of the tube is preferably positioned immediately adjacent the upper surface of the foil, and may preferably face laterally toward the side of the craft, or rearwardly, away from the flow of water. This will ensure a reliable low pressure coupling of the opening to the foil.

FIG. 12 illustrates a further preferred embodiment of the ventilator system. In this figure the ventilator tubes 220 are positioned inside, or are made integral with, foil struts 118. In addition, a ventilator extension tube 226 extends laterally within the interior of foil 120, and has a plurality of orifices 228 extending through the upper surface 121 of the foil, which will bleed air inducted through ventilator tubes 220 to the upper surface of the foil. This configuration is expected to increase the effectiveness of the ventilation.

The two ventilator tubes 220 could communicate with the entire ventilator extension tube, or, preferably, the ventilator extension tube will comprise two separate tubes 230, 232 and each ventilator tube 220 may be in fluid communication with only the portion of the extension tube 226 on the side of the craft on which the respective ventilator tube 220 is disposed. This arrangement can provide a limited amount of roll control, in addition to or as an enhancement to the depth control, in that, if one side of the craft is raised higher, for example, with the operator leaning considerably to one side, the ventilator on that raised side will operate to decrease lift on the foil on the raised side thereby tending to right the craft, while the ventilator on the lower side will not be significantly decreasing lift on the opposite side.

Figure 13A:
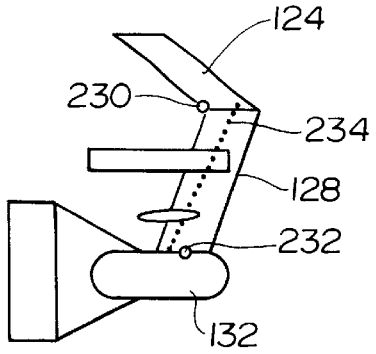
FIGS. 13A–C are substantially schematic side elevation views of the hydrofoil water craft of the present invention, illustrating operational details of the pivoting propulsion subassembly.
Figure 13B:
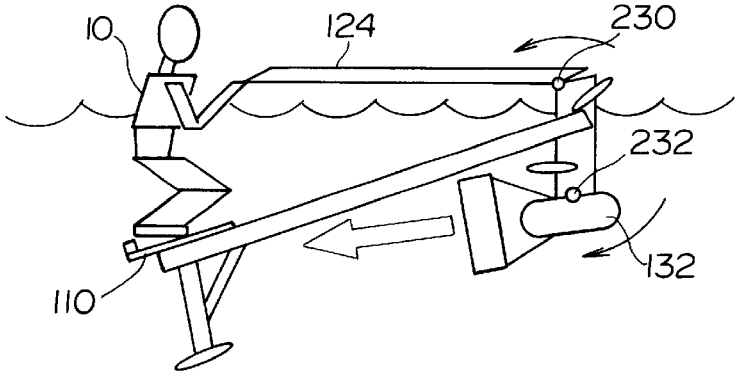
Figure 13C:
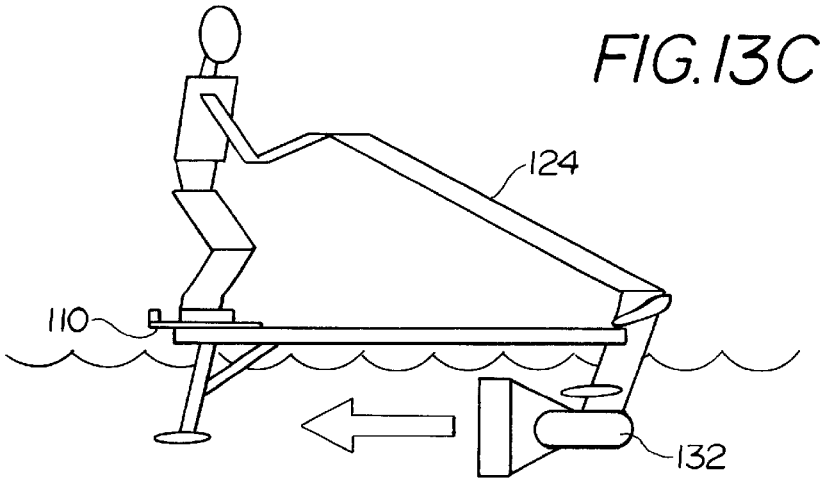

FIGS. 13A–C illustrate a further feature of the propulsion and steering system in accordance with a preferred embodiment of the present invention. In these figures, the propulsion and steering system is assembled to the main strut subassembly 106 such that the propulsor housing and propeller can pivot or rock relative to the strut 108, and such that the longitudinal axes of these components will not always be in parallel.

Figure 14A:
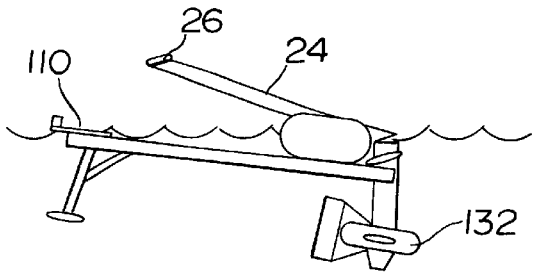
FIGS. 14A–D are substantially schematic side elevation views of the hydrofoil water craft of the present invention, illustrating the position of the craft and the operator during a typical take-off sequence.
Figure 14B:
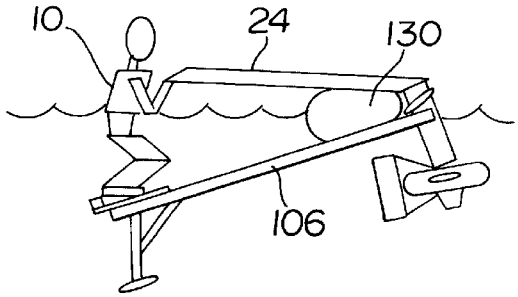

The main object of providing a rocking propulsion subassembly is to facilitate the initial take-off of the vehicle, as will be discussed in greater detail below. Referring now to FIGS. 14A–D, a typical take-off sequence is illustrated schematically. With no operator onboard, the vehicle or craft 100 is partially buoyant, with portions of the craft extending above and below the surface of the water, as seen in FIG. 14A. The operator 10 mounts or boards the craft 100 preferably by kneeling or crouching on the operator platform 110, as shown in FIG. 14B. In this position, the forward end of the craft remains near the surface of the water, while the operator platform 110 lowers under the weight of the operator.

Figure 14C:
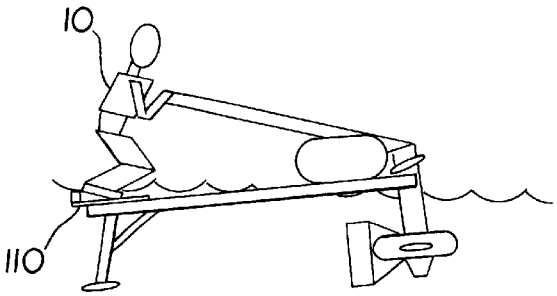
Figure 14D:
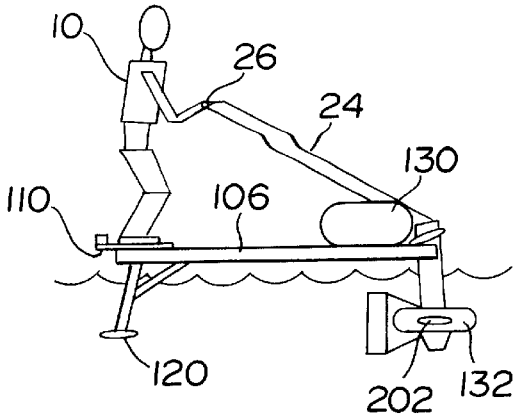

The operator 10, using the controls disposed on handlebar 126, starts the craft moving in the water, whereupon the rear foil subassembly and the lift provided by the operator platform 110 cause the rear portion of the craft to rise such that the operator platform breaks the surface of the water, as seen in FIG. 14C. Further increases in craft speed result in a further raising of the operator platform due to the lift provided by foil 120. In full operation (FIG. 14D), the operator platform 110, motor housing 130, and strut assembly 106 travel above the surface of the water, due primarily to the lift provided by main foil 120, with lift also contributed by foils 202 attached to the propulsor housing 132.

Returning now to FIGS. 13A–C, the components enabling the propulsor housing 132 to be rocked during take-off will be described. Control column 124 is pivotably connected to control housing 128 by a suitable hinged connection 230 (see also FIG. 7) or other means. This pivotable connection is desired even when the rocking propulsor housing is not employed, so that the handlebar 126 can travel between a lowered position and a raised position, to enable the handlebars to be held comfortably when the operator is kneeling or standing, and to accommodate a range of operator heights.

Where a rocking propulsor is used, the propulsor housing 132 is hingedly connected to the steering mechanism (plate 170 in FIG. 7) by hinge means 232. This connection is made at the rear portion (aft of center) of the propulsor housing. A rod or cable 234, shown schematically in FIG. 13A, is secured to the control column 124 at a point which will pivot upwardly when the handlebar at the end of the control column is pivoted downwardly, or is at a lowered position (FIG. 13B). The opposite end of rod or cable 234 is secured to the propulsor housing 132 at a point rearward of the hinged connection. Thus, when the handlebar is lowered, the rod or cable pulls the rear portion of the propulsor housing upwardly, and, when the handlebar 126 is raised, the propulsor housing is able to pivot back into its normal orientation or position. The propulsor housing preferably would have a biasing means to retain it in contact with plate 170 in the absence of a substantial downward force being applied to the handlebar 126 and control column 124.

The rocking propulsor housing facilitates an easier and potentially quicker take-off for the craft. In the at-rest position (FIG. 13B), the vehicle, with an operator or rider 10 in place, is pitched upwardly. While this has the benefit of angling the foils to better generate lift, the propulsor housing 132, if not pivotable, would also be similarly upwardly pitched. This would cause the propulsor subassembly to have a tendency to broach the surface of the water, which can cause the propeller 162 to ventilate with air, and thereby lose thrust and efficiency.

Maintaining the handlebar 126 and control column in the lowered position will raise the back end (and lower the front end) of the propulsor housing, as seen in FIG. 13B. This will decrease the relative pitch of the propulsion system to the surface of the water, and will direct the thrust generated by the propeller directly at the underside of the operator platform 110. In the take-off sequence, operator platform 110 provides lift while emerging from the water, and the propulsion thrust thus boosts the lifting forces acting on the platform. This results in the operator and platforms being more easily lifted prior to the craft's achieving higher speeds. Since less of the operator will be in the water creating drag, the vehicle can be propelled forward with less power. Finally, the thrust of the propeller will be more closely in line with the desired direction of motion, thereby maximizing the use of the thrust to propel the craft forward.

The propulsor section would preferably be able to pivot on the order of about 10–20 degrees from its normal position, but this can be varied to accommodate specific geometries of the craft.

Figure 15:
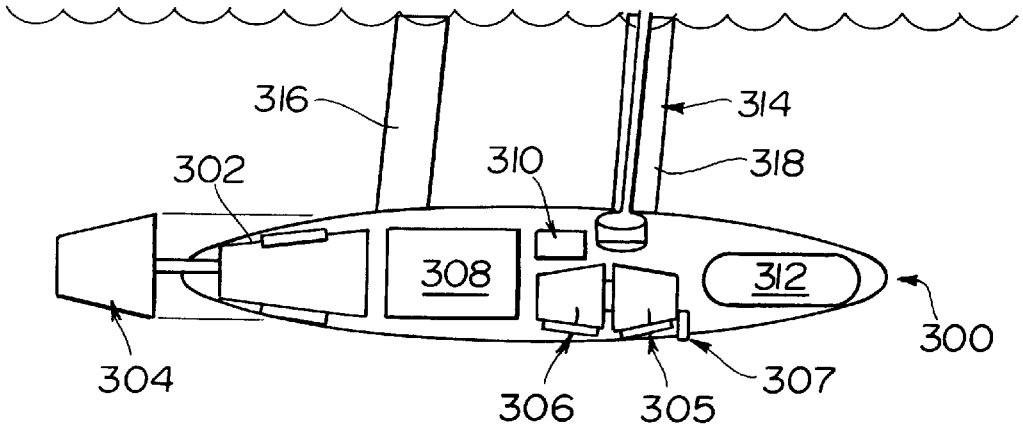
FIG. 15 is a substantially schematic view of a propulsion system and the arrangement of the components thereof in accordance with an alternative preferred embodiment of the present invention.
Figure 16:
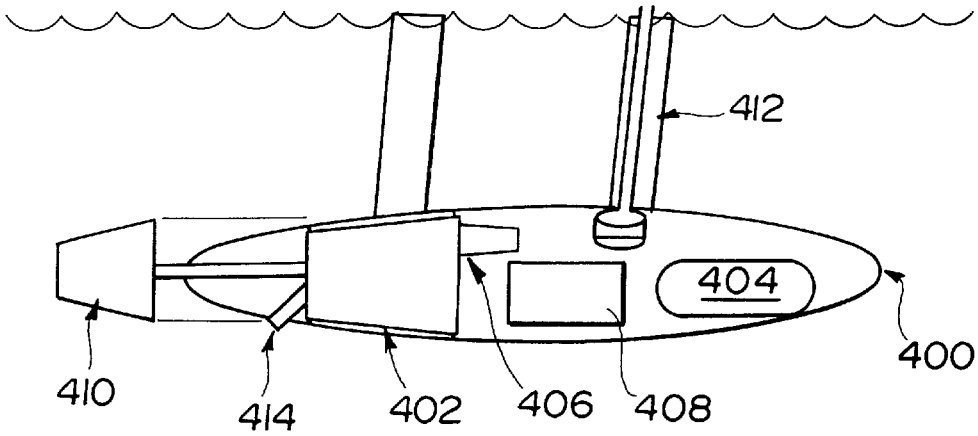
FIG. 16 is a substantially schematic view of a propulsion system and the arrangement of the components thereof in accordance with an alternative preferred embodiment of the present invention.

FIGS. 15 and 16 illustrate two alternative preferred arrangements of a fully submersed propulsion subassembly, which could be employed in place of the partially submersed or split systems illustrated in FIGS. 7–9. The principal differences between the two embodiments in FIGS. 15 and 16 are the type of drive motor and auxiliary equipment employed.

In FIG. 15, a pressurized propulsion enclosure 300 is provided. In this configuration, an electric motor 302 is used to power a ducted propulsor 304. Electric motor 302 is, in turn, powered by a gas-powered motor/generator combination 305, 306. The motor 305 has an exhaust port 307 extending through the wall of the enclosure. The generator output can drive the electric motor directly and/or can be stored in battery 308 under the control of charge controller 310. Fuel for the gas-powered motor is stored in fuel cell 312.

The use of this power plant configuration provides high efficiency, lower gas motor power requirements, allowing use of a smaller gas motor, and a built-in thrust reverse capability. The craft may also be operated on battery power alone intermittently, allowing extremely quiet operation, and limited "get home" operation in the event of a gas motor failure.

The propulsion enclosure 300 may also be provided with a snorkel tube 314 to allow air to be inducted into the enclosure by the motor, thereby allowing the enclosure to operate as a compressed air plenum for supercharging the gas motor. Enclosure 300 may be mounted to the underside of the strut subassembly by a pair of propulsion support struts 316, 318.

The FIG. 16 embodiment is a gas engine powered system. Propulsion enclosure 400 contains a gas engine/motor 402, a fuel cell 404, a starter motor 406 and battery 408 used to power the starter motor. The motor output is used to power the propulsor 410. As in the FIG. 15 embodiment, the propulsion enclosure has a snorkel tube 412, and an engine exhaust port 414. While this configuration may be somewhat less efficient than that illustrated in FIG. 15, it may be less expensive to construct. Overall, submersing the entire propulsion system in either of these arrangements offers the benefits of better sound isolation, lower foil lift requirements, and greater inherent stability.

Figure 17:
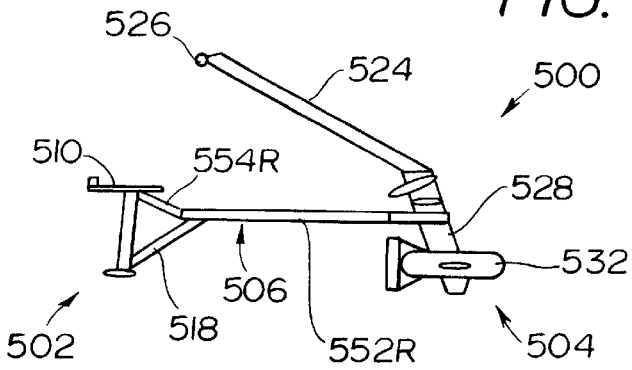
FIG. 17 is a substantially schematic side elevation view of the hydrofoil water craft in accordance with an alternative preferred embodiment of the present invention.
Figure 18:
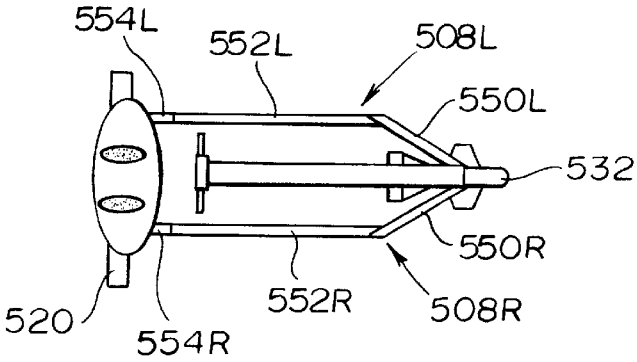
FIG. 18 is a substantially schematic top plan view of the hydrofoil water craft in accordance with an alternative preferred embodiment of the present invention.
Figure 19:
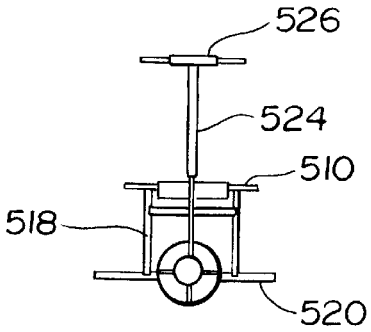
FIG. 19 is a substantially schematic front elevation view of the hydrofoil water craft in accordance with an alternative preferred embodiment of the present invention.

FIGS. 17–19 illustrate an alternative preferred configuration of the personal water craft 500 of the present invention. The principal difference between this embodiment and the embodiment illustrated in FIGS. 1–3 is the construction of the strut subassembly 506. In this embodiment, the craft still has a forward propulsor housing 532, a control housing 528, control column 524, handlebar 526, rear operator platform 510 and rear foil assembly 502, including main foil 520.

Strut subassembly 506 in this embodiment comprises a pair of laterally spaced struts 508L, 508R (FIGS. 18, 19) that connect the propulsor subassembly 104 to the foil subassembly 102. Each of struts 508L and 508R is made up of strut sections, a forward section 550L,R which connects to the control housing 528, and branches to the left or right, respectively, a middle longitudinal section 552L,R, connected to and extending from the forward sections to rear sections 554L,R. Rear sections 554L,R connect to the rearward end of middle sections 552L,R, and to the underside of operator platform 510, at the point where foil struts 518 connect. Auxiliary foil struts 522 also connect to the rearward end of middle sections 552L,R, and to a lower end of foil struts 518.

The craft of the present invention is on the order of ten (10) feet in overall length, and the height from the main foil 120 to the operator platform 110 may be on the order of about 30 inches or less. The span of the main foil 120 is preferably 48 inches or less, with the operator platform preferably being several inches less in span than the main foil. The craft thus is of a manageable size for a single user, and can readily be trailered in a manner similar to the current trailering of the hulled personal water craft now on the market.

Figure 22:
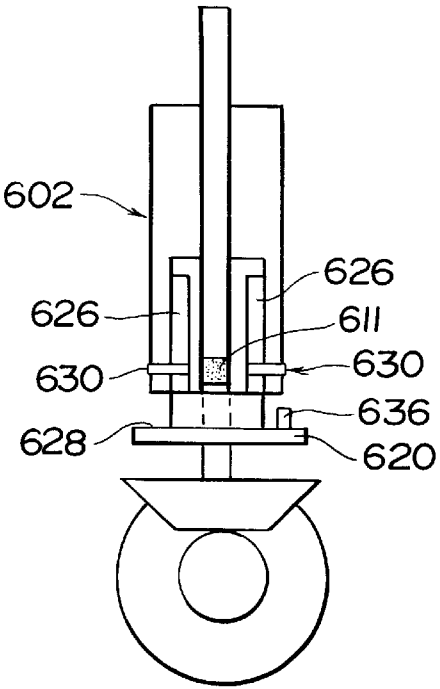
FIG. 22 is a front elevation view of internal components of the propulsion system illustrated in FIG. 20.
Figure 20:
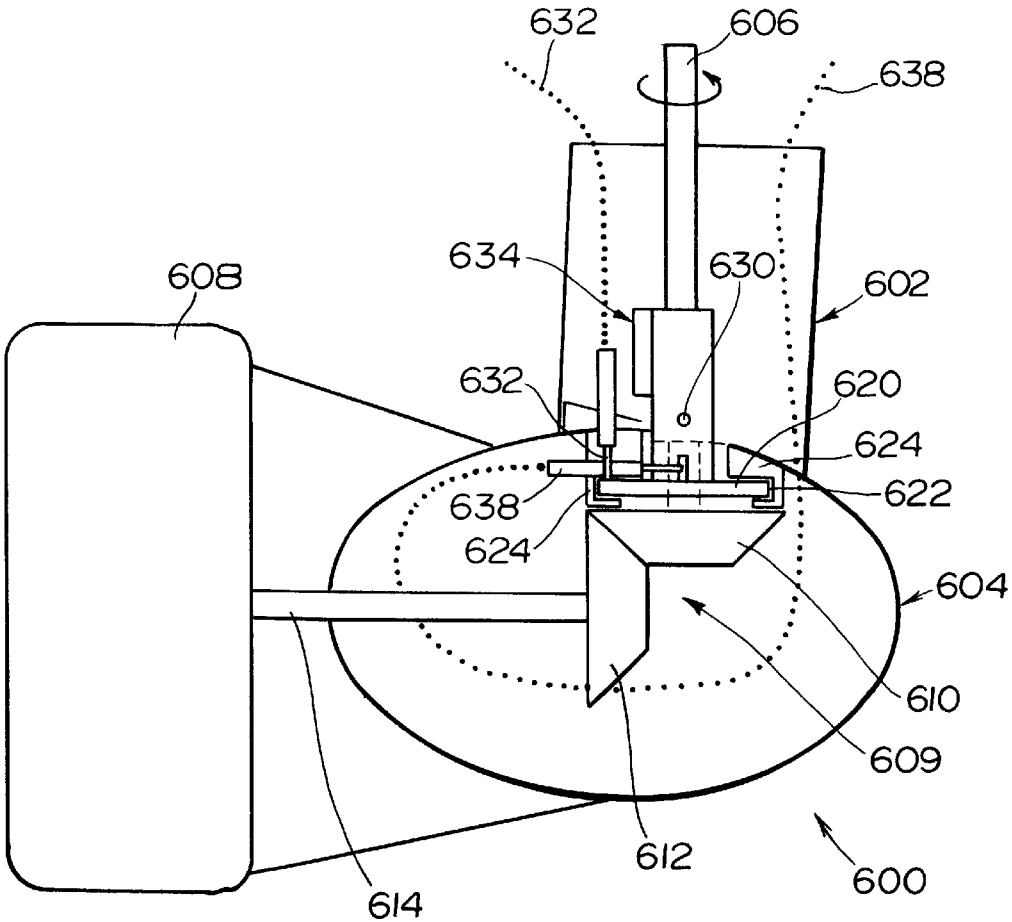
FIG. 20 is a substantially schematic view of a propulsion system and an arrangement of the components thereof in accordance with an alternative preferred embodiment of the present invention.
Figure 21:
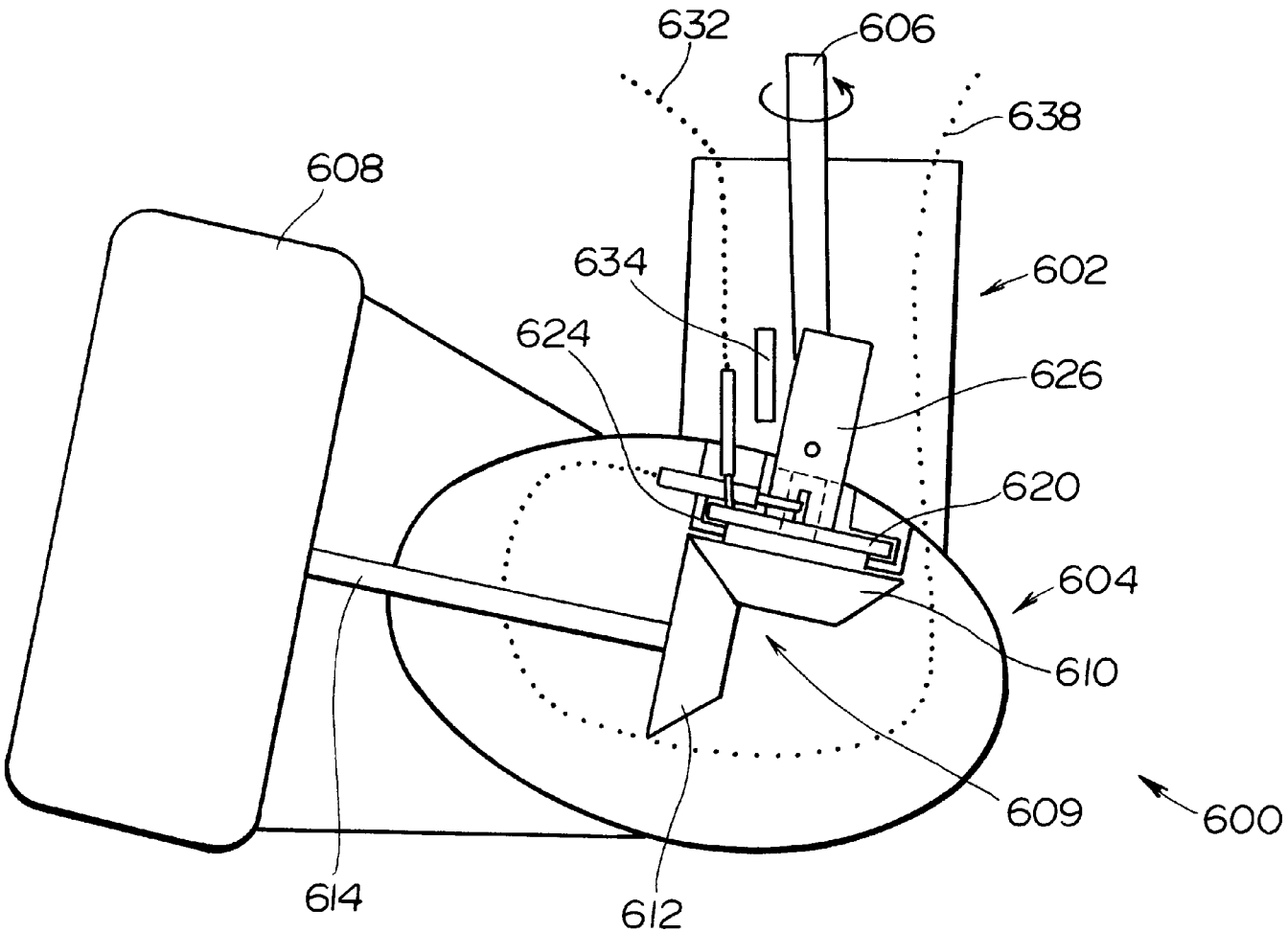
FIG. 21 is a substantially schematic view of the propulsion system of FIG. 20 illustrating the manner in which the system rocks the propulsor.

FIGS. 20 and 21 illustrate a further preferred embodiment of the propulsion subassembly of the present invention. FIG. 22 is a front elevation view of certain internal components of the propulsion subassembly.

This propulsor subassembly 600 includes a control housing or strut 602 and a propulsor housing or gear housing 604 which is positioned below the control housing. Control housing or strut 602 is secured to the forward end of the craft (not shown in FIGS. 20, 21) and depends downwardly therefrom.

Extending through control housing 602 is a drive shaft 606, coupled at its upper end to an output of a motor. Drive shaft 606 is operatively coupled to ducted propulsor 608 by a bevel gear pair 609, which comprises drive gear 610 and driven gear 612. Drive shaft 606 may include a universal joint or a flexible coupling (shown schematically in FIG. 22 at reference numeral 611) connecting it to bevel gear 610, so that the drive shaft can continue to drive the gear pair when the propulsor housing is rocked or pitched, relative to the drive shaft. The driven gear 612 of the gear pair is connected to the propulsor 608 by a driven gear shaft 614, which is connected to driven gear 612 and extends from the interior to the exterior of propulsor housing 604.

The propulsor housing or gear housing 604 is coupled to the control housing or strut 602 by means of a control disc 620 captured in a channel 622 of a bracket 624, the bracket being secured to an upper inner wall of the propulsor or gear housing 604. Control disc 620 is circular (actually, a short cylinder), and has a pair of spaced fork members 626 extending perpendicularly upwardly from an upper surface 628 of the disc. The fork members 626 are connected by pins 630 to the control housing 602, which allows the fork members to pivot relative to the control housing, thereby pivotably securing the propulsor or gear housing 604 thereto.

A rocking control cable 632, illustrated as a sleeved control cable, is connected to the control disc 620 at a point to the aft of the fork members 626. The rocking control cable can be operated by push/pull control rods or arms (not shown), and can move the propulsor or gear housing from a normal, non-rotated axial orientation (FIG. 20) to a rotated orientation (FIG. 21), by pulling upwardly on the rear of the control disc 620. The control disc 620, in turn, rotates bracket 624 in which it is captured, thereby rotating the propulsor or gear housing 604 and propulsor 608. It is expected that it will be undesirable to allow the propulsor housing to be rocked or rotated in the opposite direction, i.e., with the propulsor 608 oriented to provide upward thrust, and, in that case, a stop element 634 may be mounted to the inner wall of control housing 602 as schematically illustrated in FIGS. 20 and 21, with the stop 634 preventing the fork members 626 from moving rearwardly past the upright or vertical orientation.

This propulsor subassembly also provides for steering control, by providing a tang or flange 636 projecting upwardly from the upper surface 628 of the control disc 620. A steering control cable 638 may preferably be attached to tang 636, and, when the cable is manipulated by the rider, the tang is pushed or pulled, thereby causing the control disc 620 and propulsor or gear housing 604 to rotate from side to side.

The controls for the rocking and steering of the propulsor or gear housing need not be sleeved cables of the push/pull type, but instead may comprise hydraulic controls or other suitable control means.

Figure 23:
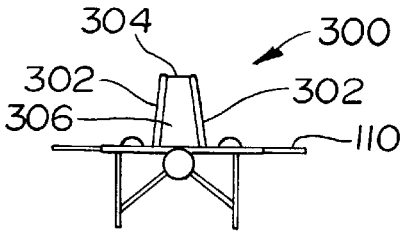
FIG. 23 is a substantially schematic front elevation view of an alternative preferred embodiment of the operator platform in accordance with the present invention.
Figure 24:
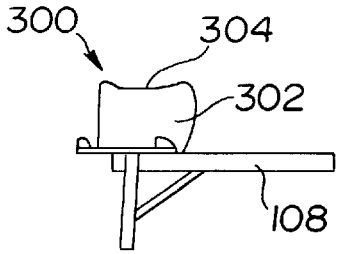
FIG. 24 is a substantially schematic side view of the operator platform of FIG. 23.

FIGS. 23 and 24 are front and side views, respectively, of an operator platform in accordance with an alternative preferred embodiment of the present invention. In this embodiment, platform 110 is equipped with a saddle-type seat 300, made up of two side panels 302 and an upper, contoured seat panel 304. In this embodiment, an operator would have the option of standing, crouching, or being seated while operating the craft.

The saddle-type seat in the illustrated embodiment has a channel 306 extending therethrough to permit water to pass through when the platform 110 is not completely elevated out of the water.

Figure 25:
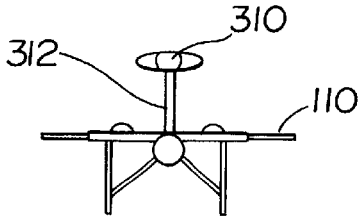
FIG. 25 is a substantially schematic front elevation view of an alternative preferred embodiment of the operator platform in accordance with the present invention.
Figure 26:
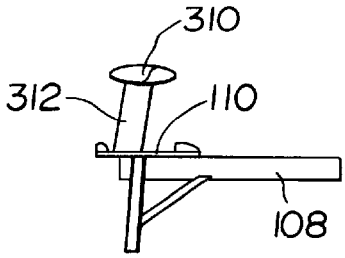
FIG. 26 is a substantially schematic side view of the operator platform of FIG. 25.

FIGS. 25 and 26 are front and side views, respectively, of an operator platform in accordance with another alternative preferred embodiment of the present invention. In this embodiment, platform 110 is equipped with a bicycle seat 310 elevated above platform 110 and supported by seat strut 312. Both the saddle-type seat and the bicycle seat configurations are perceived as being desirable primarily as a function of customer preference, and the addition of either seat to the operator platform is not seen as having any dramatic impact on the operation of the craft.

Figure 27:
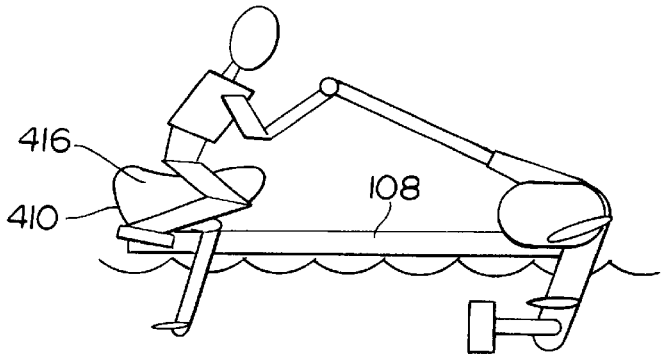
FIG. 27 is a substantially schematic side elevation view of the hydrofoil water craft in accordance with a preferred embodiment of the present invention.
Figure 28:
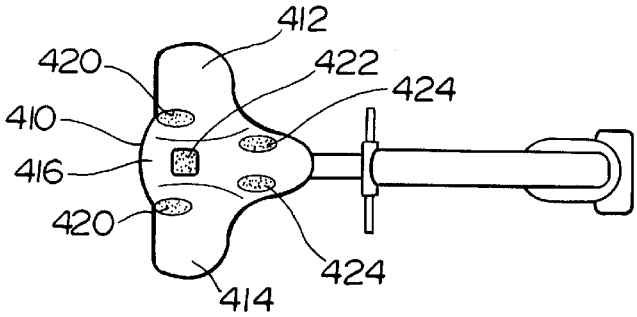
FIG. 28 is a substantially schematic top plan view of the hydrofoil water craft in accordance with a preferred embodiment of the present invention.
Figure 29:
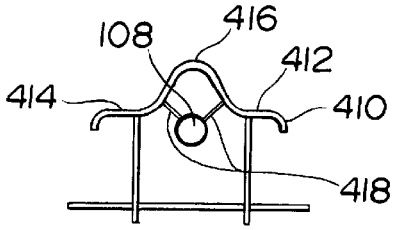
FIG. 29 is a substantially schematic rear elevation view of the hydrofoil water craft in accordance with a preferred embodiment of the present invention.

FIGS. 27–29 are side, top and rear views of a further preferred embodiment of the craft of the present invention. In this embodiment, the operator platform 410 is not entirely substantially planar, but rather has two wing sections 412, 414, and a raised central saddle section 416.

As can be seen by comparing this embodiment to the FIG. 23 embodiment, which adds a saddle seat to the planar operator platform 110, the embodiment shown in FIGS. 27–29 simply forms the footing elements (wing sections 412, 414) integrally with the saddle portion (saddle section 416). In making this a unitary component, it can be seen, in FIG. 29, that a central planar portion of the operator platform 110 may be omitted, and the operator platform 410 may be secured to strut 108 by one more platform struts 418 (two shown).

It can be seen in FIG. 28 that the operator platform 410 is provided with several areas of non-skid surfaces, including footing surfaces 420, seating surface 422, and crouching surfaces 424. The crouching surfaces are positioned to engage the inside of the knee, thigh and/or calf, of the rider. The non-skid surfaces provide traction and increased stability for the rider, in the available operating positions, which primarily include standing, sitting and crouching/kneeling. A saddle-type operator platform will allow the rider to closely conform his or her body to the operator platform (see FIG. 27), thereby streamlining the body and reducing drag during the takeoff sequence.

As noted previously, the operator platform of the present invention preferably has an aspect ratio of at least about ½, and more preferably at least about one (1). In measuring the aspect ratio of platform 110, for example, the overall dimensions of the platform would be used in determining the aspect ratio. For a non-uniformly shaped platform, such as platform 410, the aspect ratio of either the entire platform 410, or of the wing sections 412, 414, should be at least about ½.

It is to be understood that the foregoing description of the preferred embodiments of the present invention is for illustrative purposes, and many variations or modifications may become apparent, upon reading this disclosure, to those of ordinary skill in the art. In particular, while the strut assembly, the operator platform, the main foil assembly, the control subassembly and the propulsion subassembly have been described as separate units that are joined together, it is envisioned that any two or more of these subassemblies or components, and even the entire craft, may be formed as an integral or unitary assembly. Such embodiments are regarded as being within the spirit and scope of the present invention. Those and other such variations and modifications are intended to fall within the spirit and scope of the present invention, and the scope of the invention is to be determined by reference to the appended claims.

What is claimed is:

1. A hull-less personal water craft comprising:

a strut assembly having a forward end and a rearward end;

an operator platform disposed at and operatively coupled to said rearward end of said strut assembly;

a hydrofoil positioned at an underside of said operator platform and spaced apart therefrom;

a control foil system disposed at and operatively coupled to said forward end of said strut assembly;

a propulsion system;

a control column having a proximal end operatively coupled to said propulsion system, said control column having an operator interface disposed at a distal end thereof; and wherein said operator platform is so constructed and arranged to have a length, a width, and a cross-section such that said operator platform provides lift during initial take-off of the craft, and is further so constructed and arranged to provide a riding surface thereon for an operator.

2. A hull-less personal water craft as recited in claim 1 wherein said operator interface is a handlebar element having at least one control element thereon for controlling said propulsion system.

3. A hull-less personal water craft as recited in claim 2 wherein said control column is pivotably coupled to said strut assembly, whereby said column can pivot between a raised and a lowered position, and wherein pivoting said column between said raised and said lowered position changes at least one operational aspect of said propulsion system.

4. A hull-less personal water craft as recited in claim 1 wherein said hydrofoil is secured to said strut assembly by at least one foil strut extending downwardly from the strut assembly substantially underneath said operator platform.

5. A hull-less personal water craft as recited in claim 1 wherein said hydrofoil has a ventilator for introducing air onto an upper surface of said hydrofoil when said hydrofoil is submerged in water.

6. A hull-less personal water craft as recited in claim 5, wherein said ventilator comprises a tube having a lower opening positioned immediately adjacent said upper surface of said hydrofoil and an upper opening at a predetermined distance above said hydrofoil.

7. A hull-less personal water craft as recited in claim 5, wherein said hydrofoil has a plurality of orifices disposed along a width of said upper surface, and said ventilator comprises a tube having an upper opening at a predetermined distance above said hydrofoil, and a lower end which extends into an interior of said hydrofoil and which is in fluid communication with said orifices in said upper surface of said hydrofoil.

8. A hull-less personal water craft as recited in claim 1 wherein said propulsion system further comprises a motor housing mounted to said strut assembly and containing a gas-powered motor therein; said gas powered motor being operatively coupled to a propulsor positioned beneath said strut assembly, wherein said propulsor is designed to remain substantially submerged in water during operation of said personal water craft.

9. A hull-less personal water craft as recited in claim 8, wherein said propulsion system includes a propulsor housing substantially rigidly coupled to said propulsor, and wherein said craft has means for pivotably changing an orientation of said propulsor housing relative to a longitudinal axis of said strut assembly.

10. A hull-less personal water craft as recited in claim 9, wherein said orientation changing means comprises linkage means attached to and extending from said control column to said propulsor housing, and wherein said control column is pivotably coupled to said strut assembly, whereby said column can pivot between a raised and a lowered position, and whereby said linkage means is so constructed and arranged to angle a front end of said propulsor housing downwardly and a rear end upwardly when said control column is pivoted toward said lowered position.

11. A hull-less personal water craft as recited in claim 1, wherein said control foil system comprises at least a first pivotable foil extending laterally from a control housing extending below said control column, and means operatively coupled to said at least first pivotable foil for pivoting said at least first pivotable foil to control a depth under a surface of a body of water at which a lower end of said control housing will travel when said craft is in operation.

12. A hull-less personal water craft as recited in claim 1, wherein said strut assembly consists of a single central axial strut.

13. A hull-less personal water craft as recited in claim 1, wherein said operator platform has a substantially foil-shaped cross-section, and wherein said operator platform is so constructed and arranged to provide a predetermined amount of floatation to a rear portion of said craft, and wherein said operator platform has an aspect ratio of about ½ or greater.

14. A hull-less personal water craft comprising:

an operator platform having an aspect ratio of about ½ or greater and being so constructed and arranged to provide hydrodynamic lift, a hydrofoil positioned at an underside of said platform, and spaced apart therefrom;

a motor propulsion system operatively coupled to said operator platform by a strut assembly; and said operator platform comprising a seating member.

15. A hull-less personal water craft as recited in claim 14, wherein said operator platform includes a substantially planar element, and wherein said seating member is secured to and extends upwardly from an upper surface of said planar element.

16. A hull-less personal water craft as recited in claim 15, wherein said operator platform has an aspect ratio of about one or greater.

17. A hull-less personal water craft as recited in claim 14, wherein said seating member of said operator platform comprises two wing sections extending laterally from a central raised saddle section.

18. A hull-less personal water craft as recited in claim 17 wherein said operator platform is provided with non-skid surfaces on said wing sections and on said saddle section.

19. A hull-less personal water craft as recited in claim 17 wherein said operator platform has an aspect ratio of about one or greater.

20. A hull-less personal water craft as recited in claim 14, wherein said seating member of said operator platform comprises a central saddle section having surfaces for engaging the thighs of the operator.

21. A hull-less personal water craft comprising:

a strut assembly having a forward end and a rearward end;

an operator platform disposed at and operatively coupled to said rearward end of said strut assembly;

a hydrofoil positioned at an underside of said operator platform and spaced apart therefrom;

a control foil system disposed at and operatively coupled to said forward end of said strut assembly;

a propulsion system;

a control column having a proximal end operatively coupled to said propulsion system, said control column having an operator interface disposed at a distal end thereof;

wherein said strut assembly comprises a central axial strut having an opening extending therethrough, and wherein an exhaust system for said propulsion system is disposed within said opening; and wherein said exhaust system is in fluid communication with an opening at a rear of said strut.

* * * * *